US009136078B1

(12) United States Patent
Woychik et al.

(10) Patent No.: US 9,136,078 B1
(45) Date of Patent: Sep. 15, 2015

(54) STIMULUS FOR ACHIEVING HIGH PERFORMANCE WHEN SWITCHING SMA DEVICES

(75) Inventors: Gerard A. Woychik, Shellsburg, IA (US); Ryan J. Legge, Cedar Rapids, IA (US); Bryan S. McCoy, Cedar Rapids, IA (US)

(73) Assignee: Rockwell Collins, Inc., Cedar Rapid, IA (US)

( * ) Notice: Subject to any disclaimer, the term of this patent is extended or adjusted under 35 U.S.C. 154(b) by 1060 days.

(21) Appl. No.: 11/903,666

(22) Filed: Sep. 24, 2007

(51) Int. Cl.
*H01H 37/50* (2006.01)
*H01H 37/32* (2006.01)
*H01H 61/01* (2006.01)

(52) U.S. Cl.
CPC ..... *H01H 37/323* (2013.01); *H01H 61/0107* (2013.01)

(58) Field of Classification Search
CPC . H01H 37/323; H01H 61/0107; H01H 71/16; H01H 71/145; H01H 2300/034; H01H 2061/0115; H01H 2061/0122; G01K 5/483; G12B 1/00; G05D 23/024
USPC ..... 337/123, 139, 140, 382, 395
See application file for complete search history.

(56) References Cited

U.S. PATENT DOCUMENTS 1,741,601 A 12/1929 Appelberg
2,317,523 A 4/1943 Delano
3,210,643 A 10/1965 Else et al.
3,634,803 A * 1/1972 Willson et al. ..... 337/123
3,725,835 A * 4/1973 Hopkins et al. ..... 337/140
3,968,380 A * 7/1976 Jost et al. ..... 307/99
4,007,404 A 2/1977 Jost et al.
4,423,401 A * 12/1983 Mueller ..... 337/107
4,544,988 A * 10/1985 Hochstein ..... 361/211
4,551,975 A * 11/1985 Yamamoto et al. ..... 60/528
4,700,541 A * 10/1987 Gabriel et al. ..... 60/528
4,734,047 A 3/1988 Krumme
4,887,430 A * 12/1989 Kroll et al. ..... 60/527
5,061,914 A * 10/1991 Busch et al. ..... 337/140
5,410,290 A * 4/1995 Cho ..... 337/140
5,570,262 A * 10/1996 Doerwald ..... 361/99

(Continued)

FOREIGN PATENT DOCUMENTS

JP 01262372 A * 10/1989 ..... F03G 7/06
JP 01262373 A * 10/1989 ..... F03G 7/06
WO WO 03/095798 11/2003

OTHER PUBLICATIONS

U.S. Appl. No. 11/963,741, filed Dec. 21, 2007, Cripe et al.

(Continued)

*Primary Examiner* — Anatoly Vortman
(74) *Attorney, Agent, or Firm* — Angel N. Gerdzhikov; Donna P. Suchy; Daniel M. Barbieri

(57) ABSTRACT

An electromechanical switching system includes a first conductive portion and a second conductive portion. The first conductive portion includes a conductive stationary end and a conductive floating end, connected by a shape memory alloy (SMA). When an input stimulus current is applied to the SMA, changes in the SMA urge motion of the conductive floating end of the first conductive portion toward the second conductive portion, which in turn causes a change in the state of the electromechanical switching system. The input stimulus current may be calculated to satisfy a given response time requirement.

13 Claims, 4 Drawing Sheets

(56) References Cited

U.S. PATENT DOCUMENTS

| | | | | |
|---|---|---|---|---|
| 5,619,177 | A * | 4/1997 | Johnson et al. | 337/140 |
| 5,629,662 | A * | 5/1997 | Floyd et al. | 337/36 |
| 5,684,448 | A * | 11/1997 | Jacobsen et al. | 337/140 |
| 5,825,275 | A * | 10/1998 | Wuttig et al. | 337/139 |
| 5,870,007 | A * | 2/1999 | Carr et al. | 333/262 |
| 6,016,096 | A * | 1/2000 | Barnes et al. | 337/123 |
| 6,049,267 | A * | 4/2000 | Barnes et al. | 337/123 |
| 6,078,243 | A * | 6/2000 | Barnes et al. | 337/140 |
| 6,133,816 | A * | 10/2000 | Barnes et al. | 337/123 |
| 6,236,300 | B1 * | 5/2001 | Minners | 337/139 |
| 6,239,686 | B1 * | 5/2001 | Eder et al. | 337/382 |
| 6,247,678 | B1 | 6/2001 | Hines et al. | |
| 6,407,478 | B1 * | 6/2002 | Wood et al. | 310/307 |
| 6,494,225 | B1 | 12/2002 | Olewicz et al. | |
| 6,516,146 | B1 | 2/2003 | Kosaka | |
| 6,708,491 | B1 * | 3/2004 | Weaver et al. | 60/527 |
| 6,762,669 | B2 * | 7/2004 | Alacqua et al. | 337/140 |
| 6,917,276 | B1 * | 7/2005 | Menard et al. | 337/140 |
| 6,972,659 | B2 * | 12/2005 | von Behrens et al. | 337/139 |
| 6,981,374 | B2 | 1/2006 | von Behrens et al. | |
| 7,036,312 | B2 * | 5/2006 | Menard et al. | 60/527 |
| 7,256,518 | B2 | 8/2007 | Gummin et al. | |
| 7,372,355 | B2 * | 5/2008 | Agronin et al. | 337/126 |
| 7,548,145 | B2 * | 6/2009 | Rubel | 335/78 |
| 2001/0010488 | A1 * | 8/2001 | Minners | 337/131 |
| 2002/0021053 | A1 * | 2/2002 | Wood et al. | 310/306 |
| 2002/0050881 | A1 * | 5/2002 | Hyman et al. | 335/78 |
| 2004/0211178 | A1 * | 10/2004 | Menard et al. | 60/527 |
| 2005/0001367 | A1 | 1/2005 | Taya et al. | |
| 2005/0115235 | A1 | 6/2005 | Mernoe | |
| 2005/0146404 | A1 * | 7/2005 | Yeatman | 335/78 |
| 2005/0184533 | A1 | 8/2005 | Hebenstreit et al. | |
| 2006/0162331 | A1 * | 7/2006 | Kirkpatirck et al. | 60/527 |
| 2008/0125974 | A1 | 5/2008 | Dubinsky et al. | |

OTHER PUBLICATIONS

U.S. Appl. No. 11/963,738, filed Dec. 21, 2007, Cripe et al.

U.S. Appl. No. 11/499,104, filed Aug. 4, 2006, Woychik et al.

International Search Report and Written Opinion for International Application No. PCT/US2008/073330, dated Mar. 6, 2009, 8 pages.

Loh, C S. et al., "Natural Heat-Sinking Control Method for High-Speed Actuation of the SMA," *Int'l Journal of Advanced Robotic Systems*, vol. 3, No. 4: 2006, pp. 303-312.

Response to Office Action in U.S. Appl. No. 11/499,104, filed with the U.S. Patent and Trademark Office on Jan. 8, 2010, 13 pages.

Office Action for U.S. Appl. No. 11/499,104, mail date Oct. 8, 2009, 10 pages.

Office Action for U.S. Appl. No. 11/499,104, mail date Mar. 25, 2010, 10 pages.

Office Action for U.S. Appl. No. 11/499,104, mail date Aug. 4, 2010, 10 pages.

Office Action for U.S. Appl. No. 11/963,738, mail date Oct. 26, 2010, 6 pages.

Office Action for U.S. Appl. No. 11/963,741, mail date Oct. 26, 2010, 6 pages.

* cited by examiner

STIMULUS FOR ACHIEVING HIGH PERFORMANCE WHEN SWITCHING SMA DEVICES

FIELD OF THE INVENTION

The present invention generally relates to the field of electromechanical switches employing shape memory alloys (SMA), and more particularly to an SMA switch having a calculated input stimulus current for the SMA for a given response time.

BACKGROUND OF THE INVENTION

Electromechanical switches are a globally established, mature design type used in every level of the electronics industry, ranging from power supplies to large high power circuit breakers and isolation circuitry. Electromechanical switches are utilized in environments ranging from relatively benign (e.g., office computers) to severe (e.g., automotive power relays).

Many electromechanical switches include solenoids and/or electric motors, which perform the physical work of bringing contacts together and creating or breaking an electrical connection. Due to the maturity of this technology, there is a limited opportunity for cost, size and weight reduction, which are three critical characteristics of a switch (relay) design.

SUMMARY OF THE INVENTION

The present invention is directed to a process for calculating an input stimulus current to a shape memory alloy (SMA)-based electromechanical switch. The input stimulus current is selected to produce a heating response for a given response time. For a desired response time, an input stimulus current is calculated that meets the timing requirement and does not deleteriously affect the structure of the SMA. As the stimulus current is applied to the SMA, a fast heating response in the SMA may cause a change in the shape of the alloy and moves the contacts of the switch, making or breaking an electrical connection. In this manner, the SMA-based switch can provide improvements to switch design that meet or exceed existing switch technology in terms of responsiveness, repeatability and reliability.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

In order to improve on existing technology, Shape Memory Alloy (SMA)-based electromechanical switches may be employed to provide a switch with improved responsiveness, repeatability and reliability. A mechanical response generated by heating an SMA with an electrical current may be used to bring contacts together, thereby making or breaking an electrical connection. SMA-based switches may have distinct advantages over solenoids and motors. By replacing solenoids and motors with SMA-based switches, critical design characteristics may be improved, such as decreasing cost, size and weight requirements.

Prior art switch designs utilizing SMA-based technologies have failed to meet some industrial requirements (e.g., fast response time, high reliability) for some SMA-based switches. Prior to the present invention, the response times of SMA materials have typically been slow (e.g., between 500 and 1,000 milliseconds typical response time). Further, SMA materials in a wire filament implementation often fail when exposed to high temperatures. It is not uncommon for an SMA wire to vaporize if a high electrical current is applied for too long of a duration.

The electromechanical switch of the present invention may create a controlled electrical stimulus current that may actuate an SMA-based electromechanical switch quickly, while still preserving the integrity of the SMA-based switch. Further, with a wire filament embodiment of an SMA-based switch design, there is a broader opportunity for applying SMA's to high performance electromechanical switch implementations.

Figure 1A:
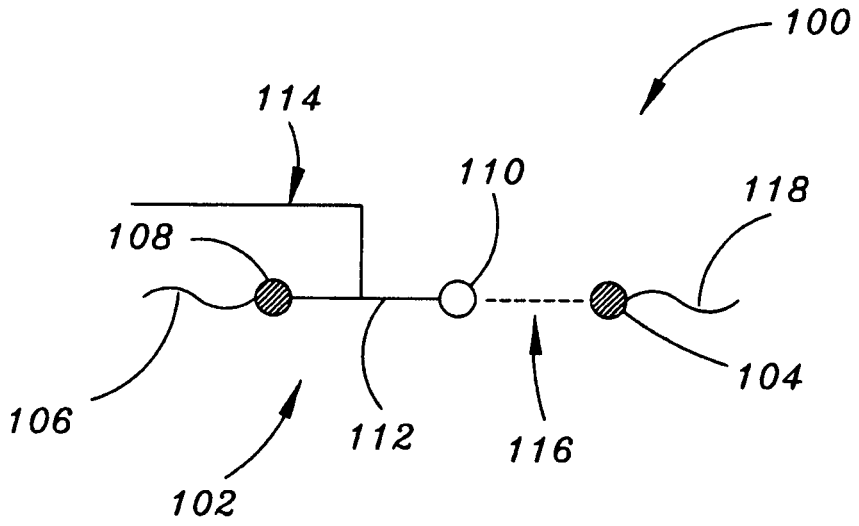
FIGS. 1A and 1B illustrate an embodiment of a shape memory alloy (SMA) based switch, wherein the SMA responds to an input stimulus current by changing its length.
Figure 1B:
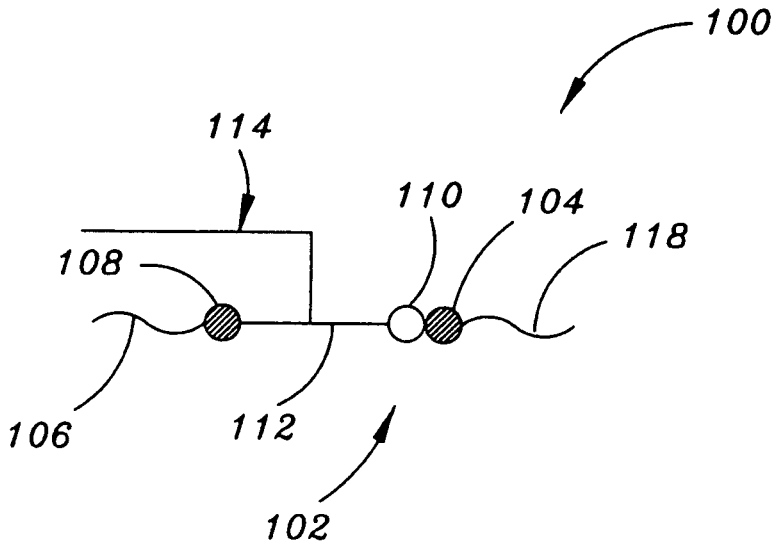

Referring now to FIGS. 1A and 1B, there is shown an SMA-based switch 100. The SMA-based switch comprises a first conductive portion 102 and a second conductive portion 104. The first conductive portion 102 further comprises a first conductive stationary end 108 and a first conductive floating end 110, connected by an SMA 112 material in a wire filament implementation. An input stimulus current 114 is applied to the SMA 112 to produce a heating response in the SMA 112 in which the SMA 112 changes its state (e.g. length and/or shape). For example, a temperature change may cause the SMA 112 to change its length (e.g. contracts or extends), urging motion of the first conductive floating end 110 towards (or away from) the second conductive portion 104 along a path 116. When the SMA 112 is contracted (in length), as shown in FIG. 1A, current flow from a first conductor 106 to a second conductor 118 is interrupted, hence the switch 100 is in a disconnected state. When the SMA 112 is extended (in length) so that the first conductive floating end 110 contacts the second conductive portion 104, as shown in FIG. 1B, current flow is allowed and the switch 100 is in a connected state.

The input stimulus current 114 is calculated for a given response time to meet the timing requirements. The calculated input stimulus current 114 produces a fast heating response in the SMA 112 and does not deleteriously affect its structure. In a specific embodiment, the SMA-based switch is capable of achieving: 1) actuation times of 5 milliseconds; 2) known repeatability of actuation in excess of 3 million of cycles or more; and 3) higher reliability of SMA-based switch (relay) design with use of a controlled and known electrical input.

The amount of energy over time flowing through the input stimulus current 114 into the SMA 112 contributes to the SMA's fast heating response. The wave shape of the stimulus current is not a factor to the response time in the SMA 112. It is contemplated that the wave shape of the input stimulus current 114 may be square, saw tooth, sine, pulse-width modulation (PWM), as well as other various shapes. The timing requirement may be satisfied so long as the energy over time provided by the input stimulus current 114 satisfies the calculated value for the given response time, regardless of the wave shape of the current.

It is further contemplated that the input stimulus current 114 may be increased or decreased in order to satisfy different response time requirements. Such changes may be accomplished without changing the overall SMA-based switch 100 design. For example, in one specific embodiment, for a given response time requirement of 6 milliseconds, an input stimulus current value may be calculated to meet the requirement. If the response time requirement is later decreased to 5 milliseconds, a stronger input stimulus current value may be calculated, which satisfies the new requirement without changing other parts of the switch. Alternatively, if the response time requirement was later extended to 7 milliseconds, a reduced input stimulus current value may be calculated to satisfy the extended response requirement, with less energy consumption while still meeting the timing requirement.

It is contemplated that SMA 112 and input stimulus current 114 may reside within a circuit loop that is isolated from a conductive path being connected/disconnected. In an alternative embodiment of the invention, SMA 112, input stimulus current 114 and the conductive path may be unisolated.

Figure 2A:
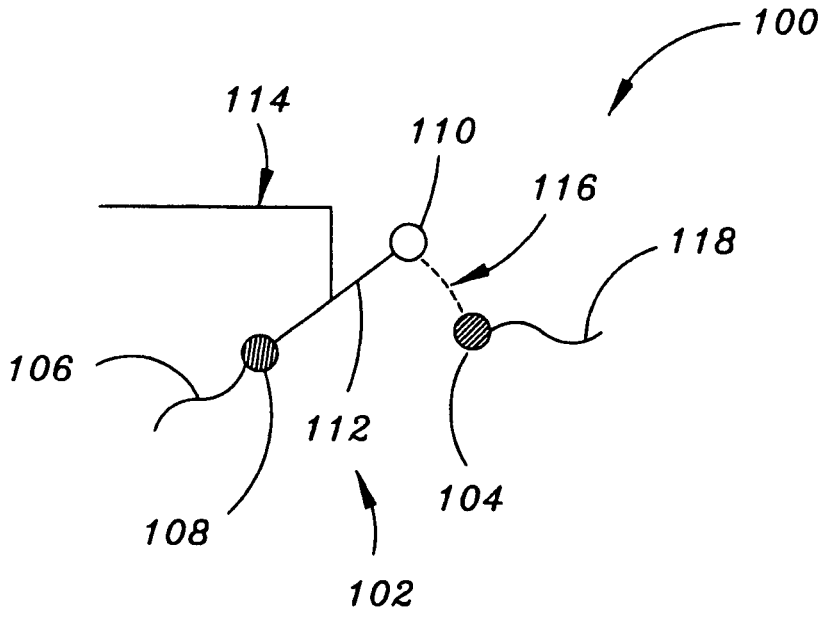
FIGS. 2A and 2B illustrate an embodiment of a shape memory alloy (SMA) based switch, wherein the SMA responds to an input stimulus current by changing its shape.
Figure 2B:
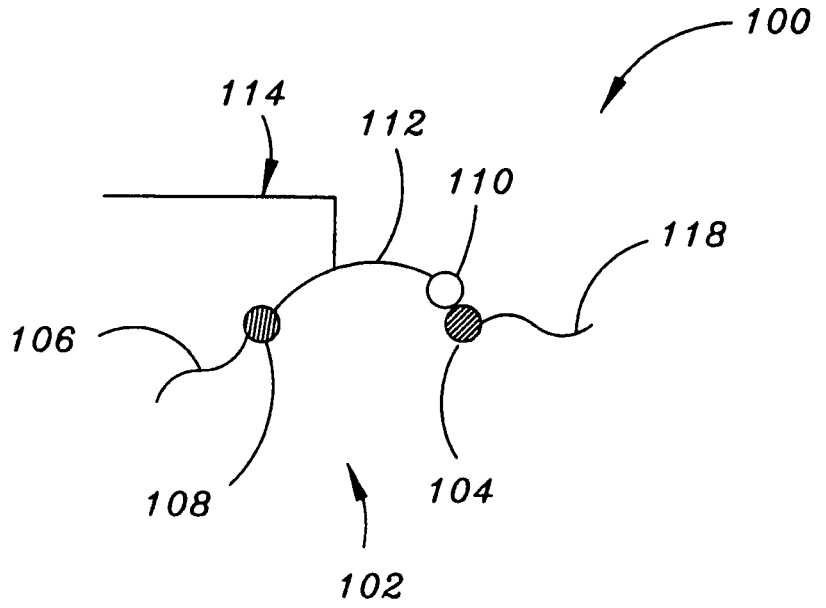

In another embodiment, shown in FIGS. 2A and 2B, the SMA 112 employed in the SMA-based switch 100 may change its shape when responding to a temperature change. When the SMA 112 is in a generally linear shape, it holds the first conductive floating end 110 away from the second conductive portion 104, as shown in FIG. 2A. In this arrangement, current flow is interrupted and the switch 100 is in a disconnected state. When the SMA 112 is in a generally semi-circular shape and the first conductive floating end 110 contacts the second conductive portion 104, as shown in FIG. 2B, current flow is allowed and the switch 100 is in a connected state. It is understood that the SMA 112 may be of different shapes, forms, and/or lengths, so long as it responds to temperature changes which in turn urge motion of the first conductive floating end 110. It is understood that alternative SMA's may be employed without departing from the scope and spirit of the present invention.

Figure 3A:
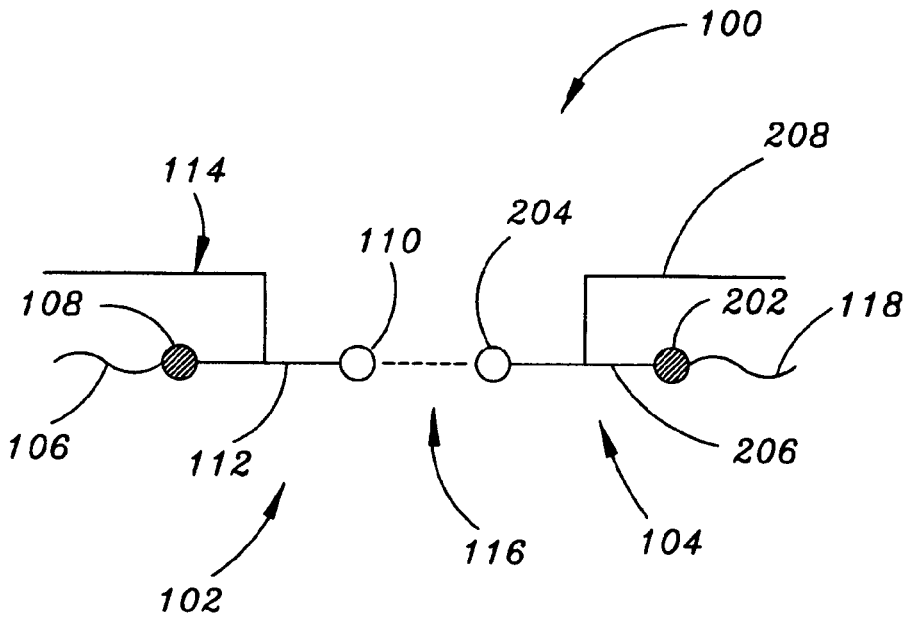
FIGS. 3A and 3B illustrate an embodiment of a shape memory alloy (SMA) based switch, wherein two SMA's are employed on each end of the switch.
Figure 3B:
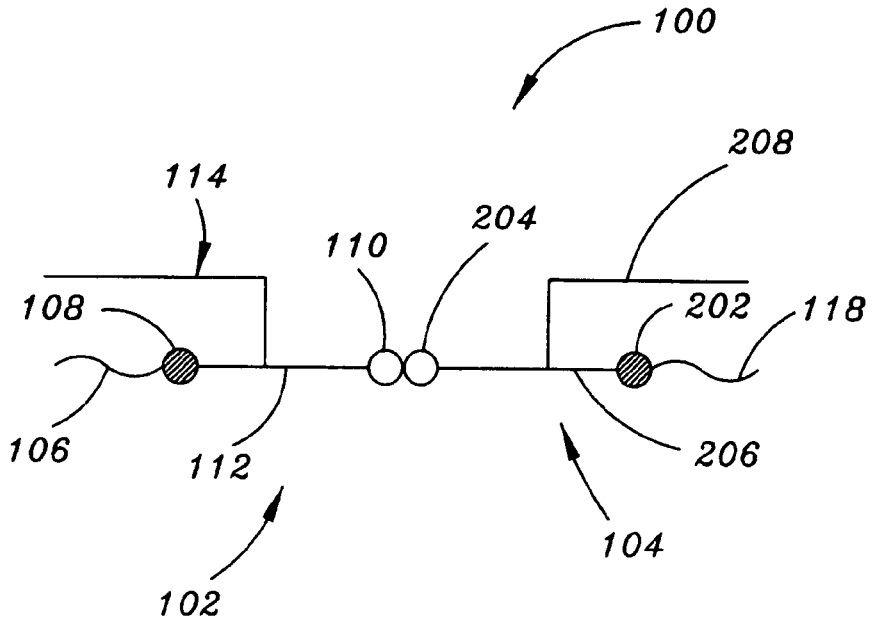

It is contemplated, as shown in FIG. 3, that the second conductive portion 104 may contain a second conductive stationary end 202 and a second conductive floating end 204, connected by a second SMA 206 material in a wire filament implementation. A second input stimulus current 208 is applied to the second SMA 206 to produce heating response in the second SMA 206. For example, temperature change can cause the second SMA 206 to change its length (e.g. contracts or extends), hence urging motion of the second conductive floating end 204 towards (or away from) the first conductive portion 102 along the path 116. When the first conductive floating end 110 and the second conductive floating end 204 are not in contact, current flow from the first conductor 106 to the second conductor 118 is interrupted; hence the switch 100 is in a disconnected state. When the first conductive floating end 110 and the second conductive floating end 204 are in contact, current flow is allowed and the switch 100 is in a connected state.

It is also contemplated that the first conductive floating end 110 and the second conductive floating end 204 may establish a connection under various conditions. For example, in an exemplary embodiment, the connection is made if and only if both the first conductive floating end 110 and the second conductive floating end 204 are moved toward the center of the path 116. Therefore the electrical connection can be established only when both the first conductive portion 102 and the second conductive portion 104 initiate the connection. In another exemplary embodiment the connection can be established if any one of the first conductive floating end 110 and the second conductive floating end 204 is moved toward its counterpart. Therefore the electrical connection can be established by either one of the first conductive portion 102 or the second conductive portion 104. It is understood that alternative designs may be employed without departing from the scope and spirit of the present invention.

It is further contemplated that the second SMA 206 and the second input stimulus current 208 in the second conductive portion 104 may operate independently from their counterparts in the first conductive portion 102. For example, the input stimulus current 114 may have a first value to satisfy a given response time, while the second input stimulus current 208 may have a different value in order to satisfy a different response time. This allows independent control by both ends of the switch, with possibly different response time requirements.

In the present invention, the input stimulus current 114 is calculated for a given response time requirement. An equation derived from the First Law of Thermodynamics is used to describe the thermodynamic characteristics of SMA in general, and is shown as follows:

$$\frac{C_1}{I^2}(T_{ON} - T_{AMB}) = 1 - \exp(-C_2 \times t)$$

In this equation, a first constant $C_1$ and a second constant $C_2$ represent two constants in the SMA-based switch 100 design. An experimental input stimulus current I represents an input stimulus current provided to the SMA 112 which will be used to calculate the desired input stimulus current 114. A state changing temperature $T_{ON}$ is a temperature at which the SMA 112 changes state (e.g. length and/or shape). An ambient operating temperature $T_{AMB}$ is an ambient operating temperature of the SMA-based switch 100. An experimental actuation time (response time) t is the amount of time takes for the SMA 112 to respond to a given experimental input stimulus current.

Figure 4:
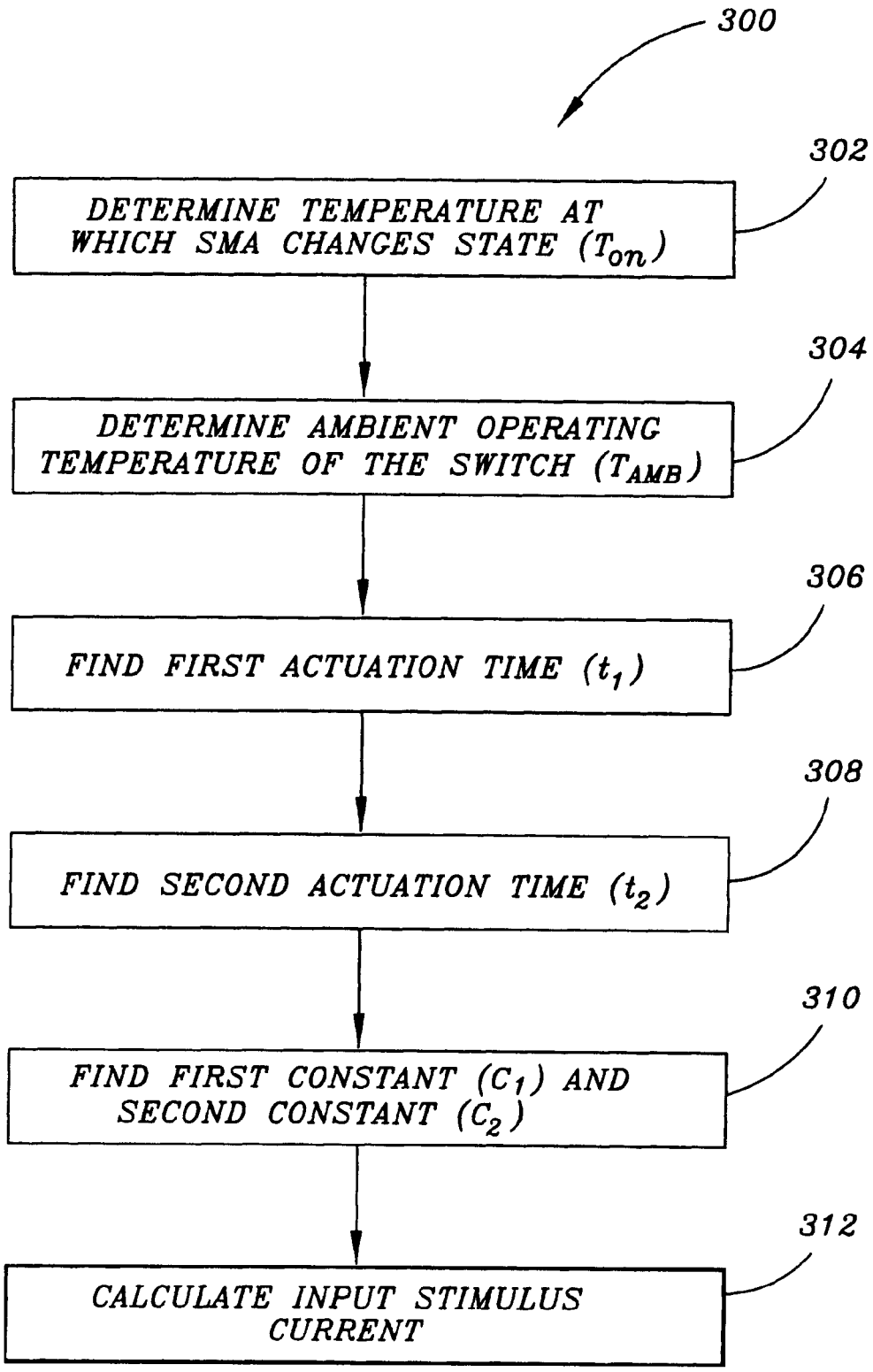
FIG. 4 is a flow diagram illustrating the basic steps performed by a method to calculate an input stimulus current in accordance with the invention.

FIG. 4 shows a flow diagram illustrating the steps performed by the method 300 to calculate the input stimulus current 114 in accordance with the present invention. In step 302 the state changing temperature $T_{ON}$ is determined. The state changing temperature $T_{ON}$ varies depending on the specific material used in the SMA 112. The value of the state changing temperature $T_{ON}$ may be determined. For example, by gradually increasing (or decreasing) the temperature of the SMA 112 and determining the temperature when the SMA 112 changes state, the state changing temperature $T_{ON}$ can be determined. In step 304 the ambient operating temperature $T_{AMB}$ of the SMA-based switch is determined. This can be determined, for example, by measuring the temperature using a temperature measuring instrument.

In step 306 a first actuation time $t_1$ in response to a first input stimulus current $I_1$ is determined. The first actuation time can be measured, for example, by measuring the amount of time needed for the SMA 112 to respond to the first input stimulus current. In step 308 a second actuation time $t_2$ in response to a second input stimulus current $I_2$, which is different from the first input stimulus current $I_1$, is determined.

In step 310, the first constant and the second constant are determined by solving a system of two equations with two unknowns. The equations are obtained by plug-in values of the variables determined in the above steps into the equation. For instance, the state changing temperature $T_{ON}$ and the ambient operating temperature $T_{AMB}$ have already been determined and they stay unchanged in the first equation and the second equation. In the first equation, the first actuation time $t_1$ is used in place of the experimental actuation time, while the first input stimulus current $I_1$ is used in place of the experimental input stimulus current. In the second equation the second actuation time $t_2$ is used in place of the experimental actuation time, while the second input stimulus current $I_2$ is used in place of the experimental input stimulus current. Therefore the value of the first constant $C_1$ and the second constant $C_2$ can be determined by solving the system of two equations.

In step 312, the desired input stimulus current 114 is calculated by solving one equation with one unknown (the input stimulus current 114). The equation is obtained by substituting values for the variables as determined in the above steps into the equation. For instance, the state changing temperature $T_{ON}$ has been determined in step 302. The ambient operating temperature $T_{AMB}$ has been determined in step 304. The first constant $C_1$ and the second constant $C_2$ have been determined in step 310. The desired actuation time (a given response time requirement) is known and is used in place of the experimental actuation time t. For example if the given response time requirement is 6 milliseconds, the value of the experimental actuation time t is set to 6 milliseconds. Therefore the value of the desired input stimulus current 114 can be determined by solving the resulting equation. This equation may be solved repeatedly for different desired actuation times to provide input currents which satisfy these actuation times.

It is believed that the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A switching system, comprising:

a first conductive portion having a first conductive stationary end, and a first conductive floating end;

a second conductive portion;

and a first shape memory alloy (SMA) for connecting the first conductive stationary end and the first conductive floating end of the first conductive portion, such that changes in the first SMA urge motion of the first conductive floating end of the first conductive portion toward the second conductive portion along a path, which in turn causes a change in the state of the switch, a control circuit providing an input stimulus current to the first SMA to produce a response in the first SMA, wherein the input stimulus current has a wave shape form having a known and controlled amount of energy over time based on a first given response time for the first SMA to change the state, wherein the second conductive portion has a second conductive stationary end and a second conductive floating end, connected by a second SMA, wherein a second input stimulus current to the second SMA produces a heating response in the second SMA, and the second input stimulus current is calculated based on a second given response time of the second SMA different from the first given response time.

2. The switch as claimed in claim 1, wherein the input stimulus current has a wave shape form comprising at least one of square, saw tooth, sine, and PWM.

3. The switch as claimed in claim 1, wherein the input stimulus current is modifiable for a third given response time.

4. The switch as claimed in claim 1, wherein the first SMA responds to the input stimulus current by changing its length.

5. The switch as claimed in claim 1, wherein the first SMA responds to the input stimulus current by changing its shape.

6. An electromechanical switching system, comprising:

a first conductive portion having a first conductive stationary end, and a first conductive floating end;

a second conductive portion;

a path from the first conductive floating end of the first conductive portion to the second conductive portion;

and a first shape memory alloy (SMA) for connecting the first conductive stationary end and the first conductive floating end of the first conductive portion, such that changes in the first SMA urge motion of the first conductive floating end of the first conductive portion toward the second conductive portion along the path, which in turn causes a change in the state of the electromechanical switching system, a control circuit providing an input stimulus current to the first SMA to produce a response in the first SMA, wherein the input stimulus current has a wave shape form having a known and controlled amount of energy over time based on a given response time for the first SMA to change the state, wherein the second conductive portion has a second conductive stationary end and a second conductive floating end, connected by a second SMA, wherein a second input stimulus current to the second SMA produces a heating response in the second SMA, and the second input stimulus current is calculated based on a second given response time of the second SMA different from the first given response time.

7. The electromechanical switching system as claimed in claim 6, wherein the input stimulus current has a wave shape form comprising at least one of square, saw tooth, sine, and PWM.

8. The electromechanical switching system as claimed in claim 6, wherein the input stimulus current is modifiable for a second given response time.

9. The electromechanical switching system as claimed in claim 6, wherein the first SMA responds to the input stimulus current by changing its length.

10. The electromechanical switching system as claimed in claim 6, wherein the first SMA responds to the input stimulus current by changing its shape.

11. The switch as claimed in claim 6, wherein the switch is configured to provide repeatability of actuation of 3 million or more cycles.

12. The switch as claimed in claim 6, wherein the first SMA responds to the input stimulus current by changing its length and its shape.

13. The switch as claimed in claim 6 wherein the control means is configured to actuate the first SMA to make or break an electrical connection with a speed of 7 milliseconds or less.

* * * * *